US010047743B2

(12) United States Patent
Bhat et al.

(10) Patent No.: US 10,047,743 B2
(45) Date of Patent: Aug. 14, 2018

(54) HIGH PRESSURE PUMP

(71) Applicant: Continental Automotive GmbH, Hannover (DE)

(72) Inventors: Uday Bhat, Bangalore (IN); Ngoc-Tam Vu, Ludwigsburg (DE); Thejesh Kumar Magadibyredevaru, Bangalore (IN); Marcin Olik, Teublitz (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 141 days.

(21) Appl. No.: 14/762,567

(22) PCT Filed: Jul. 31, 2014

(86) PCT No.: PCT/EP2014/066558
§ 371 (c)(1),
(2) Date: Jul. 22, 2015

(87) PCT Pub. No.: WO2015/032558
PCT Pub. Date: Mar. 12, 2015

(65) Prior Publication Data

US 2016/0186742 A1 Jun. 30, 2016

(30) Foreign Application Priority Data

Sep. 4, 2013 (IN) ..... 2629/DEL/2013

(51) Int. Cl.
*F04B 53/16* (2006.01)
*F04B 53/14* (2006.01)
(Continued)

(52) U.S. Cl.
CPC ..... *F04B 53/143* (2013.01); *F02M 59/025* (2013.01); *F02M 59/442* (2013.01);
(Continued)

(58) Field of Classification Search
CPC ..... F04B 53/164
See application file for complete search history.

(56) References Cited

U.S. PATENT DOCUMENTS 4,906,167 A * 3/1990 Besic ..... F04B 53/164 417/437
4,976,192 A * 12/1990 Grach ..... F04B 53/164 277/351
(Continued)

FOREIGN PATENT DOCUMENTS

EP 1975402 A1 10/2008 ..... F02M 59/10
JP 2005023791 A 1/2005 ..... F02M 59/44
(Continued)

OTHER PUBLICATIONS

Chinese Office Action, Application No. 201480011237.8, 13 pages, dated Jun. 1, 2016.
(Continued)

*Primary Examiner* — F. Daniel Lopez
(74) *Attorney, Agent, or Firm* — Slayden Grubert Beard PLLC

(57) ABSTRACT

A high pressure pump for delivering a fluid includes a pump housing with a longitudinal axis and a housing cavity, a piston partly arranged in the housing cavity and axially moveable within the housing cavity and having an axial end directed opposite a driving side of the high pressure pump, and a sealing unit having a sealing body arranged radially outside of the piston such that a first part of the housing cavity is sealed fluid-tight against a second part of the housing cavity. The sealing body includes a neck with an inner diameter smaller than a first diameter of a part of the piston arranged between the sealing body neck and the axial end of the piston. The piston has a second diameter in an
(Continued)

axial area in which the sealing body neck is arranged, which second diameter is smaller than the first diameter.

13 Claims, 3 Drawing Sheets

(51) Int. Cl.

| | |
|---|---|
| ***F02M 59/44*** | (2006.01) |
| ***F04B 53/00*** | (2006.01) |
| ***F04B 53/02*** | (2006.01) |
| ***F04B 53/22*** | (2006.01) |
| ***F02M 59/02*** | (2006.01) |
| ***F04B 19/22*** | (2006.01) |

(52) U.S. Cl.
CPC ..... *F04B 19/22* (2013.01); *F04B 53/008* (2013.01); *F04B 53/02* (2013.01); *F04B 53/16* (2013.01); *F04B 53/164* (2013.01); *F04B 53/22* (2013.01)

(56) References Cited

U.S. PATENT DOCUMENTS

| | | | | |
|---|---|---|---|---|
| 7,637,508 | B2 * | 12/2009 | Montipo | F04B 53/164 277/500 |
| 7,794,216 | B2 | 9/2010 | Kitamura | 417/470 |
| 2008/0122184 | A1 | 5/2008 | Hocker et al. | 277/366 |
| 2012/0195778 | A1 | 8/2012 | Koga et al. | 417/540 |

FOREIGN PATENT DOCUMENTS

| | | | | |
|---|---|---|---|---|
| JP | 2007009750 | A | 1/2007 | F02M 59/02 |
| JP | 2007154728 | A | 6/2007 | F02M 59/10 |
| WO | 2012/085635 | A1 | 6/2012 | F02M 53/00 |

OTHER PUBLICATIONS

International Search Report and Written Opinion, Application No. PCT/EP2014/066558, 15 pages, dated Oct. 15, 2014.
Japanese Office Action, Application No. 2015559525, 8 pages, dated May 9, 2016.

* cited by examiner

HIGH PRESSURE PUMP

CROSS-REFERENCE TO RELATED APPLICATIONS

This application is a U.S. National Stage Application of International Application No. PCT/EP2014/066558 filed Jul. 31, 2014, which designates the United States of America, and claims priority to IN Application No. 2629/DEL/2013 filed Sep. 4, 2013, the contents of which are hereby incorporated by reference in their entirety.

TECHNICAL FIELD

The invention relates to a high pressure pump for the delivery of a fluid.

BACKGROUND

In today's automotive engine systems, there is an increased demand for low cost direct injection with high reliability. In common rail injection systems, the fuel is delivered by means of a high pressure pump from a fuel tank to a fuel rail which serves as a storage reservoir for the fuel. The fuel is under high pressure in the fuel rail, or common rail, and can be injected directly into the cylinder via injection valves connected to the rail.

SUMMARY

One embodiment provides a high pressure pump for the delivery of a fluid comprising a pump housing with a longitudinal axis and a housing cavity, a piston being partly arranged in the housing cavity and being axially moveable within the housing cavity and having an axial end directed opposite to a driving side of the high pressure pump, and a sealing unit with a sealing body being arranged radially outside of the piston, so that a first part of the housing cavity is sealed fluid-tight against a second part of the housing cavity, wherein the sealing body comprises a neck with an inner diameter which is smaller than a first diameter of a part of the piston, which is arranged between the neck of the sealing body and the axial end of the piston, wherein the piston comprises a second diameter in an axial area in which the neck of the sealing body is arranged, which is smaller than the first diameter of the piston.

In a further embodiment, the sealing body axially protrudes from the housing cavity in direction to the driving side and the neck of the sealing body is arranged in an area in which the sealing body protrudes from the housing cavity.

In a further embodiment, the sealing body comprises a first axial ending area facing towards the driving side, wherein the neck of the sealing body is arranged in the first axial ending area of the sealing body.

In a further embodiment, the sealing body comprises an inner surface, which is facing towards the piston and wherein the inner surface comprises at least one sealing bulge protruding towards the piston.

In a further embodiment, an inner diameter of the respective sealing bulge corresponds approximately to a respective diameter of the piston in an axial area of the piston in which the respective sealing bulge is arranged.

In a further embodiment, the respective sealing bulge has a triangular shape.

In a further embodiment, the sealing unit comprises a first seal for sealing the fluid, and the sealing body comprises a second axial ending area direct opposite to the driving side of the high pressure pump, wherein the second axial ending area of the sealing body radially overlaps the first seal.

In a further embodiment, the sealing body comprises an outer surface, which is facing towards the pump housing, wherein the outer surface of the sealing body comprises a retaining bulge, wherein an outer diameter of the retaining bulge is larger than an inner diameter of the pump housing in an axial area of the pump housing in which the retaining bulge is arranged.

In a further embodiment, the high pressure pump further comprises a retaining ring, which is arranged in a designated recess of the pump housing, wherein the retaining bulge of the sealing body rests on the retaining ring.

Another embodiment provides a high pressure pump for the delivery of a fluid comprising a pump housing with a longitudinal axis and a housing cavity, a piston being partly arranged in the housing cavity and being axially moveable within the housing cavity, and a sealing unit with a sealing body being arranged radially outside of the piston, so that a first part of the housing cavity is sealed fluid-tight against a second part of the housing cavity, wherein—the sealing unit comprises a first seal for sealing the fluid and the sealing body comprises a second axial ending area direct opposite to the driving side of the high pressure pump, wherein the second axial ending area of the sealing body radially overlaps the first seal.

Another embodiment provides a high pressure pump for the delivery of a fluid comprising a pump housing with a longitudinal axis and a housing cavity, a piston being partly arranged in the housing cavity and being axially moveable within the housing cavity, and a sealing unit with a sealing body being arranged radially outside of the piston, so that a first part of the housing cavity is sealed fluid-tight against a second part of the housing cavity, wherein the sealing body comprises an outer surface, which is facing towards the pump housing, wherein the outer surface of the sealing body comprises a retaining bulge, wherein an outer diameter of the retaining bulge is larger than an inner diameter of the pump housing in an axial area of the pump housing in which the retaining bulge is arranged.

BRIEF DESCRIPTION OF THE DRAWINGS

Example embodiments are explained below with reference to the drawings, in which.

DETAILED DESCRIPTION

Figure 1:
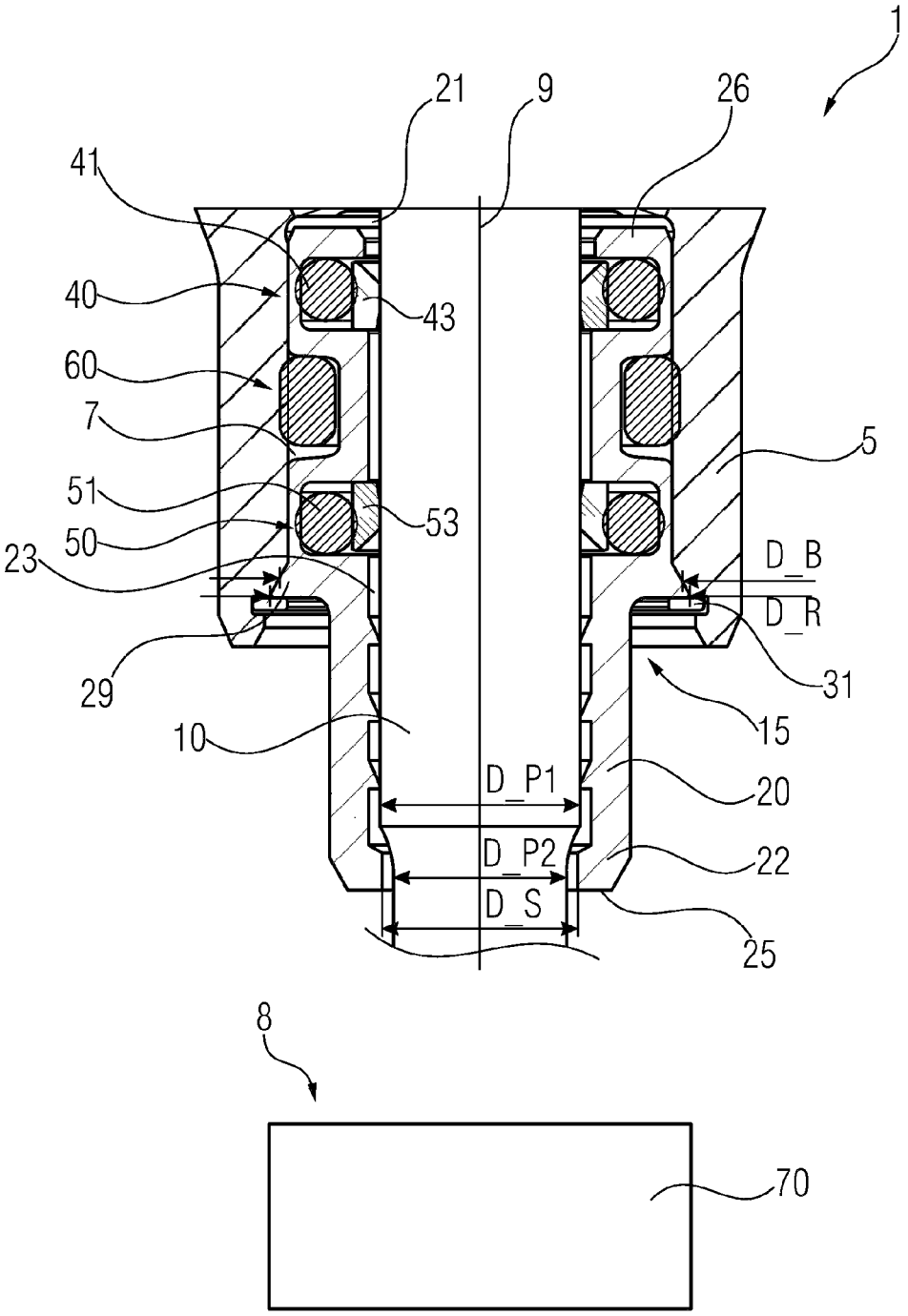
FIG. 1 shows a high pressure pump with a sealing unit, according to an example embodiment.

Embodiments of the invention provide a low cost high pressure pump with a high reliability.

Embodiments of the invention provide a high pressure pump for the delivery of a fluid. The high pressure pump comprises a pump housing with a longitudinal axis and a housing cavity. The high pressure pump comprises a piston being partly arranged in the housing cavity and being axially moveable within the housing cavity and having an axial end directed opposite to a driving side of the high pressure pump. The high pressure pump comprises a sealing unit with a sealing body being arranged radially outside of the piston, so that a first part of the housing cavity is sealed fluid-tight against a second part of the housing cavity. The sealing body comprises a neck with an inner diameter which is smaller than a first diameter of a part of the piston, which is arranged between the neck of the sealing body and the axial end of the piston. The piston comprises a second diameter in an axial area in which the neck of the sealing body is arranged, which is smaller than the first diameter of the piston.

Hereby the sealing unit provides at least two functions. First, the sealing unit seals the first part of the housing cavity fluid-tight against the second part of the housing cavity, so that a fluid in the first part, as for example fuel, does not come into contact with another fluid in the second part, as for example oil. Second, by the neck the piston is locked in the housing cavity during transport. These two function are achieved by an easy construction with one sealing unit with the sealing body which is, in particular, formed integrally. Thus no complex construction for these two functions is necessary. Thus a low cost high pressure pump with a high reliability is provided.

According to one embodiment the sealing body axially protrudes from the housing cavity in direction to the driving side and the neck of the sealing body is arranged in an area in which the sealing body protrudes from the housing cavity.

If oil splashes on the piston, a malfunction of the high pressure pump may occur, because of oil leaking into the first part of the housing cavity. The neck of the sealing body contributes to avoiding oil splashing on the piston on the driving side. Thus the sealing unit hereby provides a further function in an easy and low cost manner. Thus a low cost high pressure pump with a high reliability is provided.

According to a further embodiment the sealing body comprises a first axial ending area facing towards the driving side, wherein the neck of the sealing body is arranged in the first axial ending area of the sealing body.

The farther axially away the arranging of the neck, the better the avoidance of oil splashing. Thus, if the neck is arranged in the axial ending area of the sealing body oil splashing can be avoided very effectively.

According to a further embodiment the sealing body comprises an inner surface, which is facing towards the piston. The inner surface comprises at least one sealing bulge protruding towards the piston.

The sealing bulge prevents oil splashing in a very effective manner. Further the sealing bulge only allows a very thin oil film on the piston. Thus oil to fuel leakage can be avoided very effectively and thus a high pressure pump with a very high reliability is provided.

According to a further embodiment the inner diameter of the respective sealing bulge corresponds approximately to a respective diameter of the piston in an axial area of the piston in which the respective sealing bulge is arranged.

Hereby the respective sealing bulge acts like a wiper blade and thus oil to fuel leakage can be avoided very effectively.

According to a further advantageous embodiment the respective sealing bulge has a triangular shape.

Hereby oil pockets for the oil film on the piston are created and thus oil to fuel leakage can be avoided very well.

According to a further embodiment the sealing unit comprises a first seal for sealing the fluid. The sealing body comprises a second axial ending area directed opposite to the driving side of the high pressure pump. The second axial ending area of the sealing body radially overlaps the first seal.

In an operating mode of the high pressure pump fluid can leak to the second axial ending area of the sealing unit. This fluid can become very hot or even vaporize due to high pressures or due to high piston speed. If the hot fluid or vapour comes into contact with the first seal, the lifetime of the seal can be decreased, because the seal can get damaged by the hot temperature of the fluid or the vapour. By the radially overlapping of the sealing body fuel cannot come into direct contact with the seal or at least not on a large surface of the seal. Thus the lifetime of the seal can be increased because the seal does not get damaged by the fuel. Thus the sealing unit hereby provides a further function in an easy and low cost manner. Thus a low cost high pressure pump with a high reliability is provided.

According to another embodiment the sealing body comprises an outer surface which is facing towards the pump housing. The outer surface of the sealing body comprises a retaining bulge. An outer diameter of the retaining bulge is larger than an inner diameter of the pump housing in an axial area of the pump housing in which the retaining bulge is arranged.

Hereby an axial movement of the sealing body is prevented. Thus the sealing unit hereby provides a further function in an easy and low cost manner. Thus a low cost high pressure pump with a high reliability is provided.

According to a further embodiment the high pressure pump comprises a retaining ring, which is arranged in a designated recess of the pump housing. The retaining bulge of the sealing body rests on the retaining ring.

Hereby an axial movement of the sealing body in direction to the driving side and in opposite direction is prevented.

Other embodiments provide a high pressure pump that comprises a pump housing with a longitudinal axis and a housing cavity. The high pressure pump comprises a piston being partly arranged in the housing cavity and being axially moveable within the housing cavity. The high pressure pump comprises a sealing unit with a sealing body being arranged radially outside of the piston, so that a first part of the housing cavity is sealed fluid-tight against a second part of the housing cavity. The sealing unit comprises a first seal for sealing the fluid. The sealing body comprises an axial ending area directed opposite to a driving side of the high pressure pump. The axial ending area of the sealing body radially overlaps the first seal.

Hereby the sealing unit provides at least two functions. First, the seal unit seals the first part of the housing cavity fluid-tight against the second part of the housing cavity, so that a fluid in the first part, as, for example, fuel does not come into contact with another fluid in the second part, as, for example, oil. Second, in an operating mode of the high pressure pump fluid can leak to the second axial ending area of the sealing unit. This fluid can become very hot or even vaporize due to high pressures or due to high piston speed. If the hot fluid or vapour comes into contact with the first seal, the lifetime of the seal can be decreased, because the seal can get damaged by the hot temperature of the fluid or the vapour. By the radially overlapping of the sealing body fuel cannot come into direct contact with the seal or at least not on a large surface of the seal. Thus the lifetime of the seal can be increased because the seal does not get damaged by the fuel. Thus the sealing unit hereby provides at least two functions in an easy and low cost manner. Thus a low cost high pressure pump with a high reliability is provided.

Other embodiments provide a high pressure pump that comprises a pump housing with a longitudinal axis and a housing cavity. The high pressure pump comprises a piston being partly arranged in the housing cavity and being axially moveable within the housing cavity. The high pressure pump comprises a sealing unit with a sealing body being arranged radially outside of the piston, so that a first part of the housing cavity is sealed fluid-tight against a second part of the housing cavity. The sealing body comprises an outer surface, which is facing towards the pump housing. The outer surface of the sealing body comprises a retaining bulge. An outer diameter of the retaining bulge is larger than an inner diameter of the pump housing in an axial area in which the retaining bulge is arranged.

Hereby the sealing unit provides at least two functions. First, the seal unit seals the first part of the housing cavity fluid-tight against the second part of the housing cavity, so that a fluid in the first part, as, for example, fuel does not come into contact with another fluid in the second part, as, for example, oil. Second, an axial movement of the sealing body is prevented. Thus the sealing unit hereby provides at least two functions in an easy and low cost manner. Thus a low cost high pressure pump with a high reliability is provided.

Figure 2:
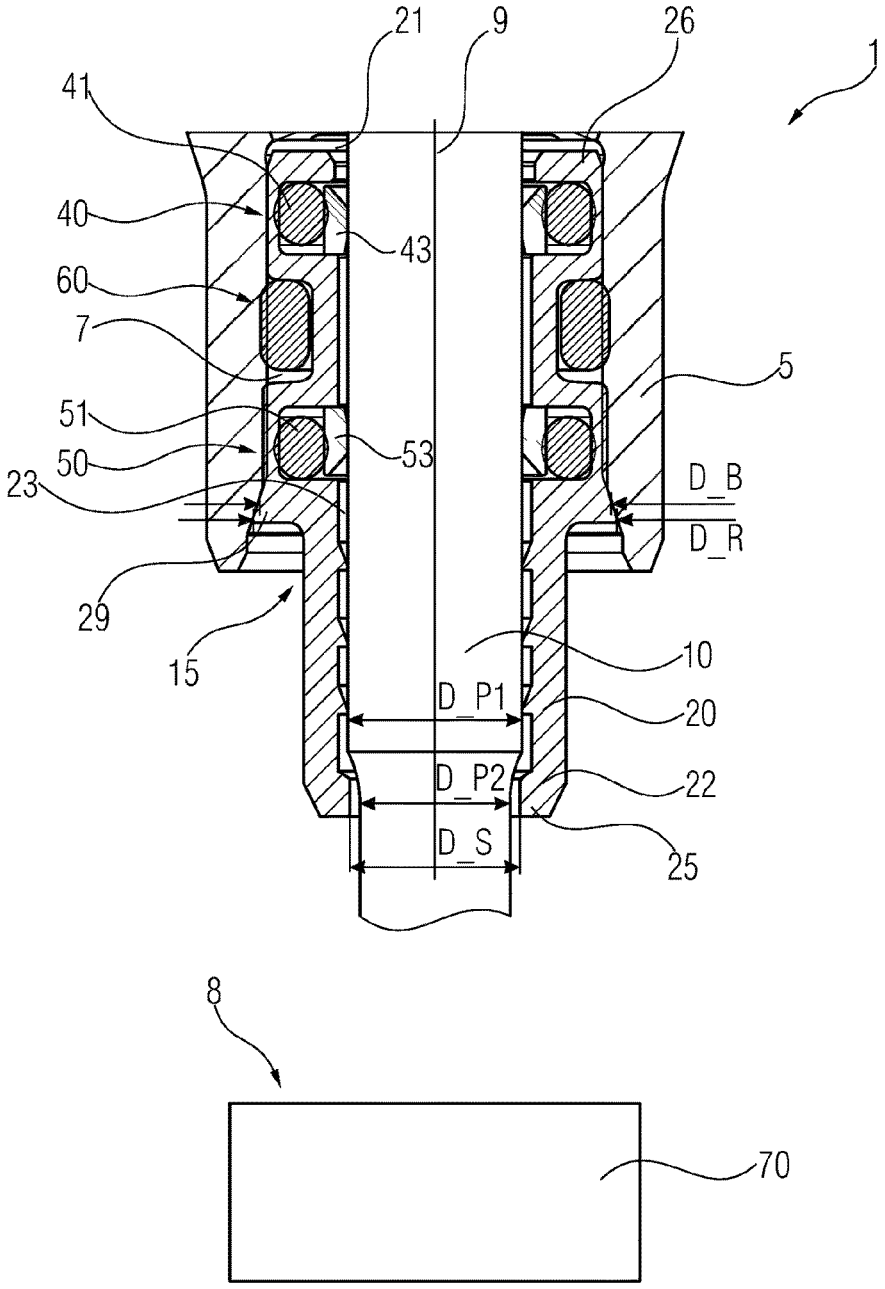
FIG. 2 shows the high pressure pump with another embodiment of the sealing unit, according to an example embodiment.

FIGS. 1 and 2 show a high pressure pump 1 with a pump housing 5 and a later described sealing unit 15. The high pressure pump 1 is, for example, a high pressure pump 1 for the delivery of a fluid, for example, fuel or diesel in a vehicle. The high pressure pump 1 is, for example, designed to create pressures up to 200 bar for fuel and/or to create pressures up to 2500 bar and more for diesel.

The pump housing 5 comprises a housing cavity 7. A piston 10 is arranged in the housing cavity 7. The piston 10 is axially moveable within the housing cavity 7 related to a longitudinal axis 9 of the high pressure pump 1.

The piston 10 is coupled with a drive shaft 70, for example, with a camshaft on a driving side 8 of the high pressure pump 1. By the use of the drive shaft 70 the piston 10 can be moved in the axial direction.

The piston 10 has a not shown axial end directed opposite to the driving side 8 of the high pressure pump 1.

The sealing unit 15 is arranged radially outside of the piston 10. The sealing unit 15 is arranged so that a first part 21 of the housing cavity 7 is sealed fluid-tight against a second part 23 of the housing cavity 7.

Figure 3:
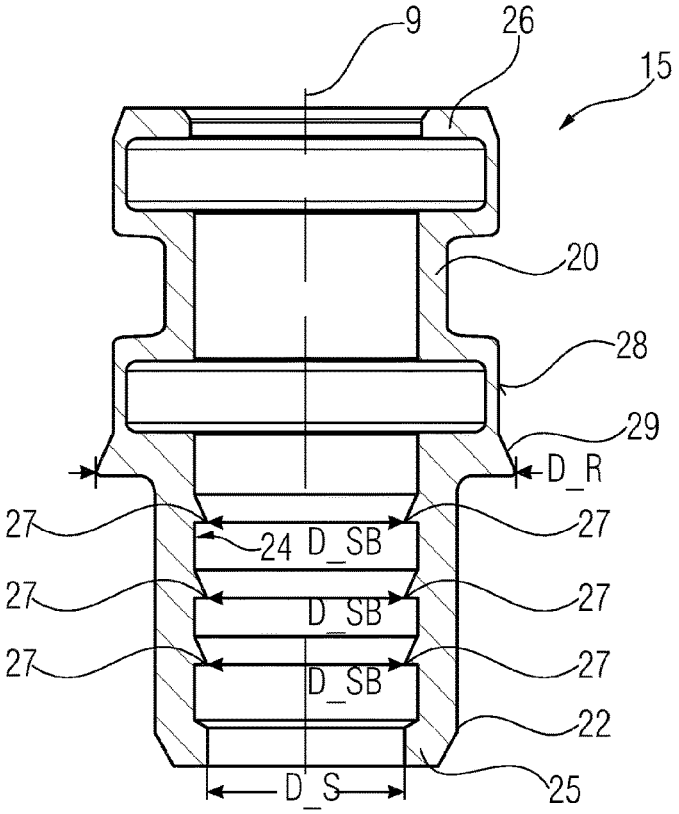
FIG. 3 shows a sealing body of the sealing unit, according to an example embodiment.
Figure 4:
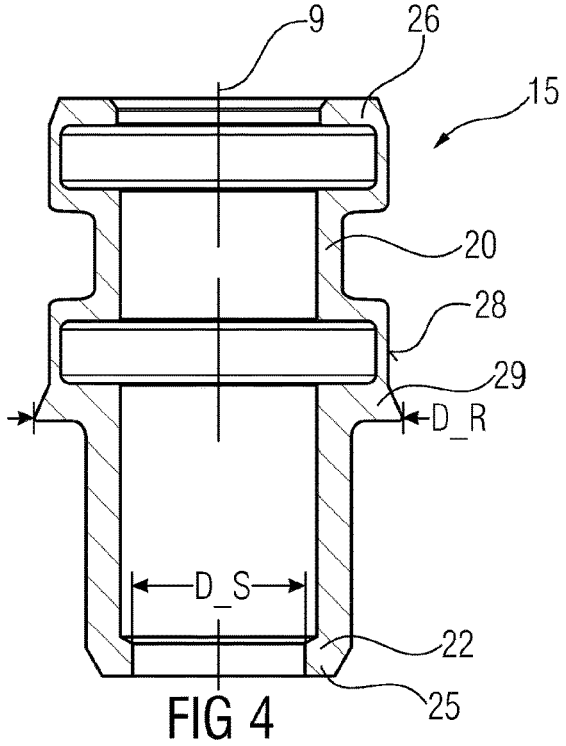
FIG. 4 shows another example embodiment of the sealing body.

The sealing unit 15 comprises a sealing body 20 which is, for example, formed integrally. FIGS. 3 and 4 show two embodiments of the sealing body 20.

The sealing body 20 comprises a neck 22 with an inner diameter D_S. The inner diameter D_S is smaller than a first diameter D_P1 of a part of the piston 10, which is arranged between the neck 22 of the sealing body 20 and the axial end of the piston 10.

The piston 10 comprises a second diameter D_P2 in an axial area in which the neck 22 of the sealing body 20 is arranged. The second diameter D_P2 of the piston 10 is smaller than the first diameter D_P1 of the piston 10.

For example, the sealing body 20 axially protrudes from the housing cavity 7 in direction to the driving side 8.

The sealing body 20 comprises, for example, a first axial ending area 25 facing towards the driving side 8.

The neck 22 of the sealing body 20 is, for example, arranged in an area in which the sealing body 20 protrudes from the housing cavity 7 and/or, in particular, in the first axial ending area 25 of the sealing body 20.

The sealing body 20, for example, comprises an inner surface 24, which is facing towards the piston 10. The inner surface 24 comprises, for example, at least one sealing bulge 27 (FIG. 3) protruding towards the piston 10.

An inner diameter D_SB of the respective sealing bulge 27 corresponds approximately to a respective diameter of the piston 10 in an axial area of the piston 10 in which the respective sealing bulge 27 is arranged, as, for example, to the first diameter D_P1 of the piston 10.

The respective sealing bulge 27 has for example a triangular shape.

The sealing unit 15 comprises for example a first seal 40 for sealing the fluid. The first seal 40 comprises for example an o-ring 41 and a lip 43 which is in contact with the piston 10.

The sealing unit 15 comprises for example a second seal 50 for sealing another fluid as, for example, oil of the drive shaft 70. The second seal 50 comprises for example another o-ring 51 and another lip 53 which is in contact with the piston 10.

The sealing unit 15 comprises for example an outer seal 60 which is for example another o-ring which seals an outer surface 28 of the sealing body 20 fluid-tight. The outer surface 28 of the sealing body 20 is facing towards the pump housing 5.

The sealing body 20 comprises for example a second axial ending area 26 directed opposite to the driving side 8 of the high pressure pump 1. For example, the second axial ending area 26, radially overlaps the first seal 40.

For example, the outer surface 28 of the sealing body 20 comprises a retaining bulge 29. An outer diameter D_R of the retaining bulge 29 is, for example, larger than an inner diameter D_B of the pump housing 5 in an axial area of the pump housing 5 in which the retaining bulge 29 is arranged.

In the high pressure pump 1 shown in FIG. 1 the retaining bulge 29 of the sealing body 20 rests on a retaining ring 31 of the high pressure pump 1, which is arranged in a designated recess of the pump housing 5.

In the high pressure pump 1 shown in FIG. 2 the sealing body 20 is connected with the pump housing 5 by a press fit.

In the following the function of the high pressure pump 1 is described in brief:

By a rotary movement of the driving shaft 70 the piston 10 is moved from an upper dead center to a lower dead center. Hereby fluid flows into a not shown high pressure chamber. By another rotary movement of the driving shaft 70 the piston 10 is moved in a stroke movement from the lower dead center to the upper dead center. By the stroke movement the fluid in the high pressure chamber is compressed. After the stroke movement the compressed fluid in the high pressure chamber can be released via an outlet valve.

Due to the high pressure a part of the compressed fluid can leak during the stroke movement from the high pressure chamber into the first part 21 of the housing cavity 7, where the second axial ending area 26 of the sealing body 20 is arranged. By the function of the sealing unit 15 this fluid does not get into contact with another fluid as, for example, with oil of the driving shaft 70.

By the radially overlapping of the sealing body 20 the fluid cannot come into direct contact with the seal 40 or at least not on a large surface of the seal 40. Thus the lifetime of the seal 40 can be increased because the seal 40 does not get damaged by the fluid.

By the function of the neck 22 the piston 10 is locked in the housing cavity 7 during transport.

If the neck 22 of the sealing body 20 is arranged in the area in which the sealing body 20 protrudes from the housing cavity 7 and/or, in particular, in the first axial ending area 25 of the sealing body 20, the neck 22 of the sealing body 20 and/or the at least one sealing bulge 27 contribute to avoiding oil splashing on the piston 10 on the driving side 8.

By the function of the retaining bulge 29 of the sealing body 20 an axial movement of the sealing body 20 is prevented.

REFERENCE NUMBERS

1 high pressure pump
5 pump housing
7 housing cavity
8 driving side
9 longitudinal axis
10 piston
15 sealing unit
20 sealing body
21 first part
22 neck
23 second part
24 inner surface
25 first axial ending area
26 second axial ending area
27 sealing bulge
28 outer surface
29 retaining bulge
31 retaining ring
40 first seal
41 o-ring
43 lip
50 second seal
51 o-ring
53 lip
60 outer seal
70 driving shaft
D_B inner diameter (of the pump housing)
D_P1 first diameter (of the piston)
D_P2 second diameter (of the piston)
D_R outer diameter (of the retaining bulge)
D_S inner diameter (of the neck)
D_SB inner diameter (of the sealing bulge)

What is claimed is:

1. High pressure pump for the delivery of a fluid, the high pressure pump comprising:

a pump housing having a longitudinal axis and a housing cavity, a piston partially arranged in the housing cavity and axially moveable within the housing cavity, a sealing unit having a sealing body arranged radially outside of the piston such that a first part of the housing cavity is sealed fluid-tight against a second part of the housing cavity, wherein the sealing body includes a first portion located within the housing cavity and a second portion axially protruding from the housing cavity in a direction toward a driving side of the high pressure pump, wherein the second portion of the sealing body axially protruding from the housing cavity comprises a neck, wherein the piston comprises a first axial portion located in the sealing body at a location axially offset from the neck of the sealing body and having a first diameter and a second axial portion located in the neck of the sealing body and having a second diameter, wherein the second diameter of the piston located in the neck of the sealing body is smaller than the first diameter of the piston located in the sealing body at the location axially offset from the neck, and wherein the sealing body includes at least one piston sealing surface configured to physically engage with the first axial portion of the piston having the first diameter the sealing body comprises at least one sealing bulge with a triangular shape protruding towards the piston, wherein the at least one sealing bulge defines the at least one piston sealing surface.

2. High pressure pump according to claim 1, wherein the neck of the sealing body is located at an axial ending area facing towards the driving side of the high pressure pump.

3. High pressure pump according to claim 1, wherein an inner diameter of each respective sealing bulge corresponds approximately to a respective diameter of the piston in an axial area of the piston in which the respective sealing bulge is located.

4. High pressure pump according to claim 1, wherein:

the sealing body comprises an axial ending area located within the housing cavity and radially covering the at least one piston sealing surface.

5. High pressure pump according to claim 1, wherein the sealing body comprises an outer surface facing towards the pump housing, wherein the outer surface of the sealing body comprises a retaining bulge having an outer diameter that is larger than an inner diameter of the pump housing in an axial area of the pump housing in which the retaining bulge is located.

6. High pressure pump according to claim 5, comprising a retaining ring arranged in a designated recess of the pump housing, wherein the retaining bulge of the sealing body rests on the retaining ring.

7. High pressure pump for the delivery of a fluid, the high pressure pump comprising:

a pump housing having a longitudinal axis and a housing cavity, a piston partially arranged in the housing cavity and axially moveable within the housing cavity, wherein the piston comprises a first axial portion having a first piston diameter and a second axial portion having a second piston diameter that is smaller than the first piston diameter, and a sealing unit comprising:

a sealing body arranged radially outside of the piston such that a first part of the housing cavity is sealed fluid-tight against a second part of the housing cavity, and a first seal that seals the fluid, wherein the sealing body includes:

a first portion extending around the first axial portion of the piston having the first piston diameter and including a retaining structure that physically retains the first seal such that the first seal physically engages with an outer surface of the first axial portion of the piston, and a neck portion extending around the second axial portion of the piston having the second piston diameter, the neck portion of the sealing body having a smaller diameter than the first piston diameter of the first axial portion of the piston; and a retaining ring arranged in a designated recess of the pump housing, wherein a retaining bulge of the sealing body rests on the retaining ring.

8. High pressure pump according to claim 7, wherein the neck portion of the sealing body axially is located in an area that protrudes from the housing cavity in a direction toward a driving side of the high pressure pump.

9. High pressure pump according to claim 7, wherein the neck portion of the sealing body is located in a first axial ending area facing towards a driving side of the high pressure pump.

10. High pressure pump for the delivery of a fluid, the high pressure pump comprising:

a pump housing having a longitudinal axis and a housing cavity, a piston partially arranged in the housing cavity and axially moveable within the housing cavity, and a sealing unit having a sealing body arranged radially outside of the piston such that a first part of the housing cavity is sealed fluid-tight against a second part of the housing cavity, wherein the sealing body comprises an outer surface facing towards the pump housing, wherein the outer surface of the sealing body comprises a retaining bulge having an outer diameter that is larger than an inner diameter of the pump housing in an axial area of the pump housing in which the retaining bulge is arranged, and a retaining ring distinct from the sealing body and arranged in a recess of the pump housing, wherein the retaining bulge of the sealing body rests on the retaining ring;

wherein the sealing body comprises a neck with an inner diameter that is smaller than a first diameter of a part of the piston arranged between the neck of the sealing body and the axial end of the piston, and the piston comprises a second diameter in an axial area in which the neck of the sealing body is arranged, wherein the second diameter of the piston is smaller than the first diameter of the piston.

11. High pressure pump according to claim 10, wherein the sealing body axially protrudes from the housing cavity in a direction toward the driving side, and the neck of the sealing body is arranged in an area in which the sealing body protrudes from the housing cavity.

12. High pressure pump according to claim 10, wherein the sealing body comprises a first axial ending area facing towards the driving side, wherein the neck of the sealing body is arranged in the first axial ending area of the sealing body.

13. High pressure pump according to claim 10, wherein the sealing body comprises an inner surface facing towards the piston, and wherein the inner surface comprises at least one sealing bulge protruding towards the piston.

* * * * *